US005806837A

United States Patent [19]

Cargill et al.

[11] Patent Number: 5,806,837

[45] Date of Patent: Sep. 15, 1998

[54] OFF-ROAD SNOW JACK

[76] Inventors: John H. Cargill, 5719 Hwy. 26, P.O. 1406; Robert O. Finley, 5777 Hwy. 26, P.O. Box 1171; John W. Finley, 41 Wagonbox La., P.O. Box 1389, all of Dubois, Wyo. 82513

[21] Appl. No.: 648,966

[22] Filed: May 17, 1996

[51] Int. Cl.[6] ..... B66D 1/00

[52] U.S. Cl. ..... 254/266; 254/47; 254/133; 254/323; 254/426

[58] Field of Search ..... 254/426, 422, 254/47, 133, 323, 335, 334, 266; 242/406

[56] References Cited

U.S. PATENT DOCUMENTS

| | | | |
|---|---|---|---|
| 1,413,039 | 4/1922 | Lee | 254/323 |
| 2,236,305 | 3/1941 | Ahlin | 242/406 |
| 2,588,749 | 3/1952 | Nilsson | 254/334 |
| 2,871,614 | 2/1959 | Roff | 254/334 |
| 3,785,541 | 1/1974 | Sibley . | |
| 3,964,729 | 6/1976 | Harlow . | |
| 3,991,978 | 11/1976 | Jones | 254/335 |
| 4,247,085 | 1/1981 | Grimsrud | 254/426 |
| 4,856,747 | 8/1989 | Gano . | |
| 4,881,864 | 11/1989 | Amoto | 254/325 |
| 5,135,200 | 8/1992 | Neibrandt . | |
| 5,143,352 | 9/1992 | Latimer . | |
| 5,145,154 | 9/1992 | Bastille et al. . | |
| 5,176,365 | 1/1993 | Best | 242/406 |
| 5,303,899 | 4/1994 | Palya | 254/334 |

OTHER PUBLICATIONS

Shade Tree Advertisement showing the E–Z Traxx snowmobile stand and the E–Z Life snownmobile lift.

Advertisement for The Bradley E–Z Lift from Sept. 1995 SnoWest magazine –p. 50.

Advertisement for Resc–You–Winch from Oct. 1995 SnoWest magazine –p. 14.

*Primary Examiner*—Katherine Matecki

*Attorney, Agent, or Firm*—Trask, Britt & Rossa

[57] ABSTRACT

A snow jack for use with snowmobiles or other off-road vehicles includes a telescoping upright structure with a ratchet and pawl lifting mechanism removably connectible at its top. A strap with a hook extends from the lifting mechanism to engage the snowmobile. The lower telescoping member has a reinforcing fiberglass core. The telescoping members may be secured relative to each other to facilitate height adjustment. Brackets are also provided to attach the upright structure to the running board of the snowmobile.

13 Claims, 8 Drawing Sheets

OFF-ROAD SNOW JACK

BACKGROUND OF THE INVENTION

1. Field of the Invention

This invention relates to jacks and, more particularly, for a jack suitable for use in snow in an off-road environment.

2. State of the Art

Snowmobiles or similar off-road vehicles can become stuck or mired in heavy snow particularly in an off-road environment. For example, a variety of surface irregularities, including creeks, stumps, fallen trees, or the like, may be hidden by snow, and create irregularities or soft spots into which the vehicle may sink. Further, there may be snow drifts or other accumulations in which the snowmobile can become mired.

Means to remove or extract snowmobiles when they are stuck in snow include, for example, simply attempting to lift or push it. However, some operators may find it difficult to do so because a snowmobile may be too heavy to lift or push. That is, some snowmobiles may weigh as much as 500 pounds so that a user may not be able to lift one end to extract it from, for example, a snowdrift.

The Bradley "E-Z" lift (Renton, Wash.) has been advertised in SNOWEST Magazine (1995). The "E-Z" lift includes a pair of lifting handles secured to the snowmobile to extend rearward. When extended or in place, the user grasps the handles for lifting with the benefit of an increased purchase.

A winch system known as the "RESC-YOU" winch also has been offered by Kalaska Enterprises in SNOWEST Magazine (1995). A rope is secured to the snowmobile track and to a nearby tree or stump. The snowmobile is then operated to move along the rope.

Inasmuch as lifting or winching is not always practical or feasible, there is a need for a jack for use in an off-road snow environment to facilitate jacking objects such as a snowmobile, vehicles similar to snowmobiles, interfering tree limbs, or the like.

SUMMARY

An off-road snow jack includes an upright structure for positioning proximate the object to be jacked. The upright structure has a lower end sized in cross-section to pass through the snow to the underlying support surface. The upright structure is sized in height to extend above the object to be jacked.

A lifting mechanism is removably positionable proximate the upper end of the upright structure. The lifting mechanism includes connecting structure for removable connection to the object to be jacked. The lifting mechanism also includes operation means to which the connecting structure is attached. The operation means is operable to tension the connecting structure to, in turn, apply a force to the object to be jacked.

The upright structure includes a plurality of telescoping members operable to vary the height of the upright structure prior to operation. The upright structure preferably includes a first telescoping member which telescopes relative to a second telescoping member. The upright structure includes first locking means to inhibit relative movement between the first telescoping member and the second telescoping member.

The upright structure desirably includes a third telescoping member which telescopes relative to the second telescoping member. The upright structure also preferably includes second locking means for inhibiting relative movement between the second telescoping member and the third telescoping member.

The first telescoping member and the second telescoping member also preferably have catch means to inhibit their disassociation. The catch means desirably includes a restriction formed proximate one end of the second telescoping member sized to mechanically contact a contact structure that extends outwardly from and is formed from the first telescoping member.

The first locking means may be a plurality of first apertures formed in the first telescoping member. A second aperture arrangement is formed in the second telescoping member to register with a selected one of the plurality of first apertures. A pin is provided for positioning through the second aperture and a selected one of the first apertures.

Alternatively, the first locking means may be a bolt threadedly engageable with a nut which is secured to the second telescoping member. The bolt is positionable through the nut and an aperture in the second telescoping member for contact with the first telescoping member.

The first telescoping member preferably has a reinforcing core which is desirably a fiberglass rod sized to be snugly and securely positioned within the first telescoping member.

In an alternative arrangement, the off-road snow jack includes a first leg rotatably attached to the upright structure to move toward and away from the upright structure. The first leg is sized the length to extend to the support surface and is operable to provide the jack with a stabilizing member. In yet another alternative arrangement, a plurality of legs, and most preferably two legs, may be provided or attached to the upright structure to stabilize the jack in use. That is, the leg or legs provide a footprint to enhance vertical stability when lifting.

In a preferred arrangement, the connection structure preferably includes a strap associated with the operation means at one end. A hook is attached at the other end. The operation means is desirably a ratchet and pawl assembly with a lever for manual operation. Alternatively, the operation means may be an electric motor interconnected through reduction gear to drive a ratchet and pawl.

In a more preferable arrangement, the lifting mechanism includes a base with an aperture formed therein. The upright structure has means associated therewith to register with the aperture of the base.

The snow jack may also be part of a system that includes attaching means which is securable to a snowmobile or similar vehicle for removably attaching the upright structure of the snow jack thereto. The attaching means desirably includes a forward bracket for removably receiving one end of the upright structure and a rear bracket for removably receiving the upright structure therein. The rear bracket preferably includes a pair of spaced apart members to receive the upright structure thereinbetween. The rear bracket also includes securing means for securing the upright structure thereto. The securing means preferably includes apertures formed in the pair of spaced apart members. A bolt or pin is sized to extend through the apertures to interconnect the spaced apart members. The bolt is operated in the apertures to prohibit movement (such as by clamping) of the upright structure relative to the attaching means. In a preferred arrangement, the upright structure includes an extension attached to extend away therefrom to strike against the bolt and, in turn, inhibit movement and retain the upright structure in the attaching means.

BRIEF DESCRIPTION OF THE DRAWINGS

In the drawings, which illustrate what is presently regarded as the preferred embodiments.

DETAILED DESCRIPTION OF THE ILLUSTRATED EMBODIMENT

Figure 1:
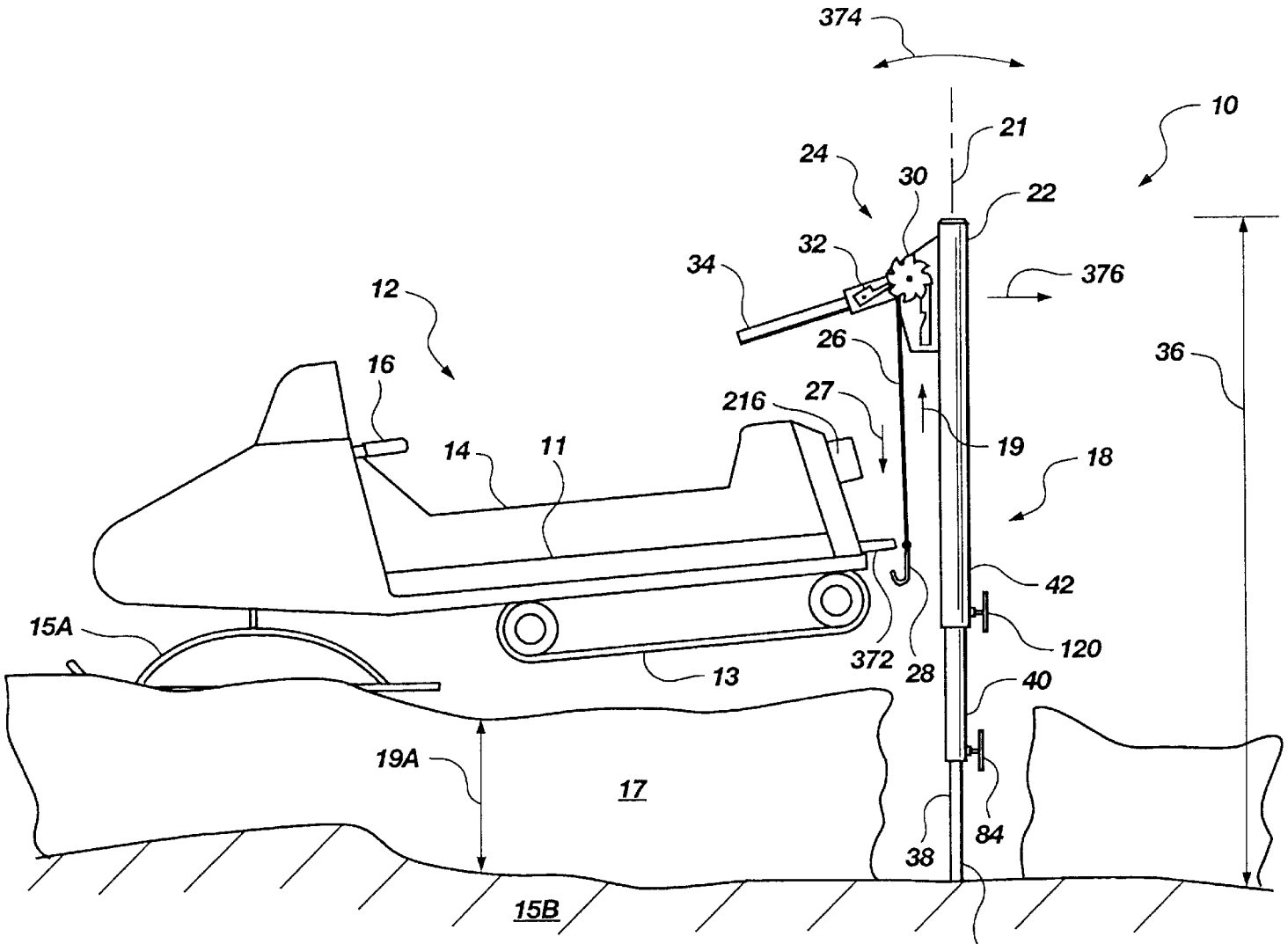
FIG. 1 depicts an off-road snow jack of the present invention positioned for use proximate a snowmobile.

In FIG. 1, an off-road snow jack 10 is positioned relative to a snowmobile 12. There are a number of different types or models of snowmobiles that have a motor that drives a track or belt 13. The user straddles a seat 14 and steers a front ski mechanism 15A with a handle 16. A running board 11 is provided for the user's feet.

The snowmobile 12 is also representative of other types of vehicles that are useable in an off-road environment. That is, the vehicles are intended for use off paved or even graded roads and are suitable for use in open or unprepared terrain. In addition to snowmobiles, examples of off-road vehicles that are here contemplated include other vehicles with tracks in lieu of wheels for use in a snow environment, some all-terrain vehicles (ATV's), and trailers suitable for towing by off-road vehicles on or in snow.

As depicted in FIG. 1, a snow covering 17 is shown positioned on its underlying surface 15B which may be any appropriate surface typically found underlying snow in an off-road environment. The snow 17 is shown to have a depth 19A that will vary but is sufficient in certain locations to mire a snowmobile or other vehicle.

As can be seen in FIG. 1, the off-road snow jack 10 is positioned proximate the object to be jacked, which here is snowmobile 12. The use contemplated is to elevate or remove the snowmobile 12 from an undesired position. For example, it may be stuck in a snow drift, snow hole, crevice or other terrain imposed situation from which the user is unable to extract the snowmobile 12. The jack 10 may also be used to move objects such as fallen trees or limbs that may be blocking the path of the snowmobile.

The snow jack 10 depicted in FIG. 1 has an upright structure 18 which is specifically positioned proximate the object to be jacked, which is here shown or depicted to be the snowmobile 12. The upright structure 18 has a lower end 20 which is sized in cross-section to readily pass through the snow 17 for contact with the underlying support surface 15B. The support surface 15B is presumably frozen. In turn, the support surface 15B provides for solid support for the upright structure 18.

A lifting mechanism 24 is removably positioned at the upper end 22 of the upright structure 18. The lifting mechanism 24 preferably has connection structure for removable connection to an object to be jacked. The connection structure here shown is a strap 26 that includes a hook 28. The hook 28 is configured to contact or hook onto the snowmobile or to hook back onto the strap 26 when the strap 26 is wrapped about an object like a tree trunk.

The lifting mechanism 24 also includes operation means to which the connection structure is attached. The operation means is operable to tension the connection structure and to apply a force to the object to be jacked. As shown in FIG. 1, the operation means is a ratchet gear 30 and pawl 32 assembly operable by a handle 34.

The upright structure 18 preferably includes a plurality of telescoping members which are operable to vary the height 36 of the upright structure 18. The height 36 of the upright structure 18 is selected to position the upper end 22 relative to the object to be jacked so the force applied 19B by the strap 26 is generally in alignment or along the axis 21 of the upright structure 18. Inasmuch as the force 19B is not coaxial with axis 21, a torque or movement will be experienced to cause the upper end 22 to rotate. The user may hold the upper end 22 to prevent rotation. Alternatively, the user may place the axis 21 at an angle to the vertical to balance the torque.

Figure 2:
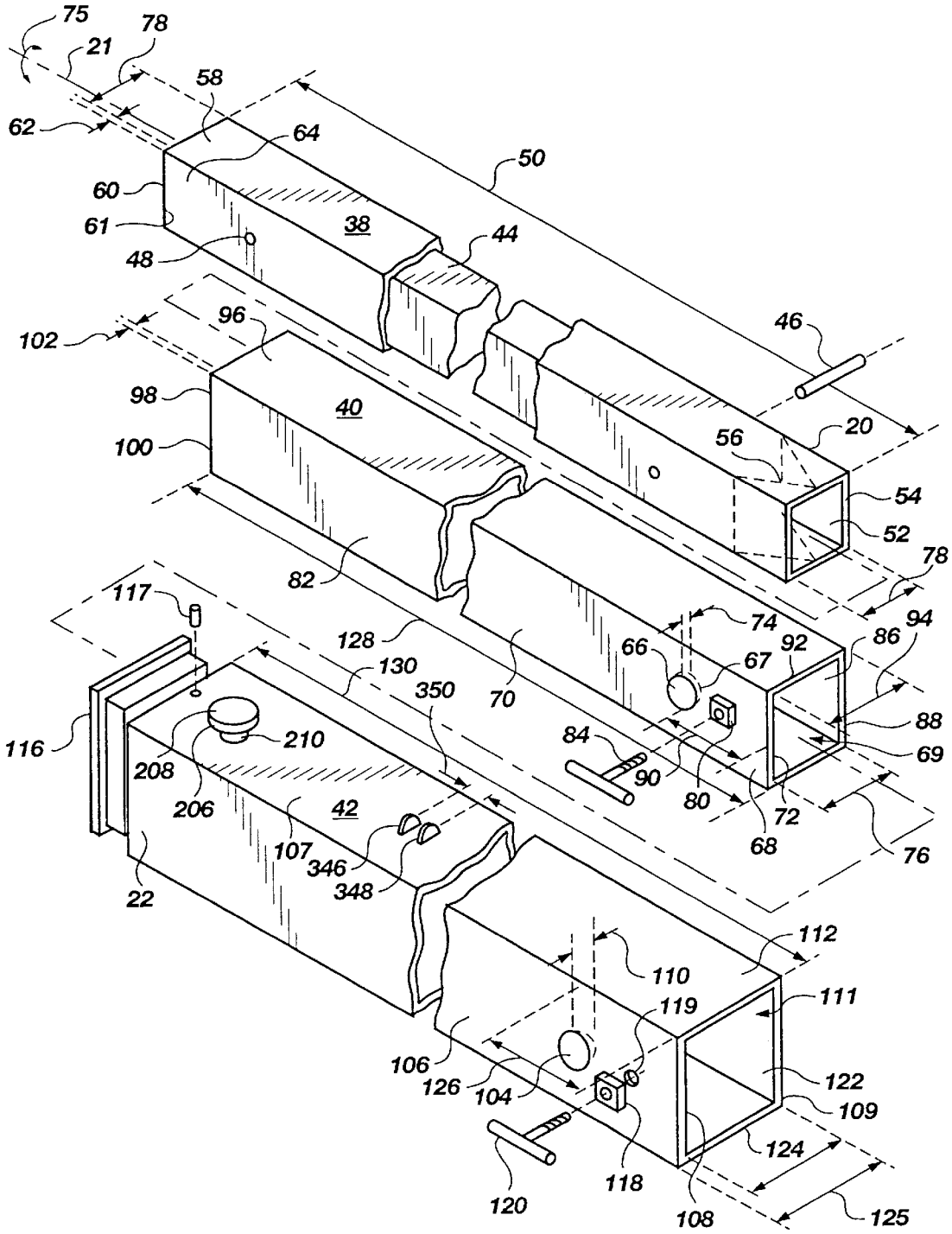
FIG. 2 is a perspective, partially cut-away, exploded view of upright structure for use with the instant invention.

Referring now to FIG. 2, the upright structure 18 is here shown to include three telescoping members 38, 40 and 42. The first telescoping member which is lower or inner tube 38 is here shown to be rectilinear in cross section and more specifically square in cross section. In order to provide strength as well as flexibility to the inner tube 38, an interior reinforcing rod 44 is snugly positioned therewithin and held in place by a pair of pins 46 and 48. The rod 44 is sized in length to be co-extensive with the length 50 of the inner tube 38.

The lower or distal end 20 is the lower end of the inner tube 38 and is here shown to be open with the lower end 52 of the rod 44 extending to present a substantially flush lower surface 54. The rod 44 is preferably made of fiberglass. However, other materials may be used so long as they provide sufficient strength to inhibit bending of inner tube 38. Indeed, in some applications the inner tube may even be made from a solid metal bar.

It may be understood that the lower end 20 may be configured in a number of geometric shapes to create a point or edge if desired. For example, the lower end may be formed into a V-shape as shown in phantom 56 to increase the frictional contact between the lower end 20 and the surface 15 and in turn to minimize slippage and increase the frictional relationship between the lower end 20 and the surface 15. Other geometrical shapes may be used as desired to provide, for example, a point or points of contact as opposed to an edge.

The upper end 58 of the inner tube 38 has an edge 60 which is rolled to extend outwardly a distance 62 (e.g., 0.063 to 0.093 inches) from the exterior surface 64 of the inner tube 38 to form a lip 61. The edge 60 may be rolled in formation of the lip 61 so that it extends outwardly approximately 90° from the exterior surface 64 of the inner tube 38.

The lip 61 constitutes contact structure to mechanically interact with a restriction formed proximate the lower end 68 of the second telescoping member or middle tube 40. More specifically, an indentation 66 is made in the sidewall 70 of the middle tube 40. The indentation 66 results in an irregularity 67 on the interior surface 72 of the sidewall 70. The irregularity 67 extends inwardly or interiorly a distance 74 sufficient to mechanically interact with the lip 61 of the inner tube 38. Upon assembly of the inner tube 38 into the middle tube 40, the lip 61 can contact the recess restriction or indentation 66 to restrict or inhibit relative movement of the inner tube 38 outwardly through opening 69 at the lower end 68 of the middle tube 40.

The lip 61 and the restriction or indentation 66 together constitute catch means which inhibit disassociation of the inner tube or first telescoping member and the middle tube or second telescoping member. The lip 61 of the inner tube 38 and the indentation 66 of the middle tube 40 are here preferred as catch means because of the simplicity in manufacture. Alternate arrangements may be developed including the placement of a welding bead on the interior surface 72 and the exterior surface 64. Use of a set screw as the restriction is also feasible. Those skilled in the art will recognize that other alternate mechanical arrangements can be provided to create a catch means to inhibit relative disassociation of the middle tube 40 and the inner tube 38.

The use of lip 61 is also preferred because the interior width 76 of the middle tube 40 is selected to be slightly larger than the external width 78 of the inner tube plus the additional distance 62 of the contact structure. The edge 60 therefore provides rotational stability. That is, the rotation 75 of inner tube 38 about axis 21 is minimized to increase the stability of the upright structure 18.

The middle tube 40 as shown in FIG. 2 has a nut 80 welded to the exterior surface 82 of the sidewall 70. A T-handled bolt 84 is provided to threadedly engage the nut 80 to extend through an aperture (not shown) formed in the sidewall 70. Upon threading the T-handled bolt 84 through the nut 80 and the corresponding aperture in the sidewall 70, the T-handled bolt 84 will contact the exterior surface 64 of the inner tube 38 to press the inner tube 38 against the interior surface 86 of the opposite sidewall 88 and to frictionally hold the inner tube 38 in place within the middle tube 40.

In other words, the nut 80 and bolt 84 together with the associated aperture function as a locking means to lock the inner tube 38 or first telescoping member in a selected position within the middle tube 40 or second telescoping member. The recess or indentation 66 is formed in a location spaced upward from the lower end 68 a distance 90 which is selected to provide sufficient axial overlap between the upper end 58 and the lower end 68 of the inner tube 38 and the middle tube 40, respectively, to provide axial rigidity and structural strength for the upright structure 18. The indentation 66 is preferably spaced upward 90 from the lower edge 92 about 3 inches for middle tube 40. Middle tube 40 is approximately 1.5 inch in exterior width 94.

The middle tube 40 has an upper end 96 which also has a lip 98 to function as contact structure. The lip 98 is formed by rolling the upper edge 100 to extend outwardly from the exterior surface 82 of the sidewall 70 the distance 102 which is preferably selected to be from about 0.063 to about 0.093 inches.

As can be seen in FIG. 2, the middle tube 40 is sized for slidable telescopic positioning within the third telescoping member or outer tube 42. The outer tube 42 has a recess 104 formed in the sidewall 106 to extend inwardly from the interior surface 108 of the sidewall 106 a distance 110. The distance 110 and the distance 102 are selected so that the lip 98 and the recess 104 will mechanically interact to inhibit disassociation of the middle tube 40 through the opening 111 in the lower end. That is, the lip 98 and the recess 104 together constitute catch means to inhibit disassociation of the second telescoping member which is the middle tube 40 and a third telescoping member which is the outer tube 42.

Upon assembly of the inner tube 38 telescopingly into the middle tube 40, and in turn upon further assembly of the middle tube 40 (with the inner tube 38) into the outer tube 42, the upright structure 18 may be then said to have 3 telescoping members. Additional telescoping sections may be used if desired. Of course, it should be understood that the telescoping arrangement can be reversed. That is, the outer tube could be formed with the end for contact with surface 15 and with the end of the inner tube configured to receive the lifting means.

An end cap 116 is positioned on the upper end 22 of the upright structure 18 which is the upper end of the outer tube 42 after assembly of the inner tube 38 and middle tube 40. The cap 116 is attached to the upper end 22 by appropriate means such as welding to provide a secure relationship to inhibit disassociation of the middle tube 40 and the inner tube 38 through the upper end 22. Alternatively, a screw 117 or bolt(s) may be used in combination to secure the cap 116 to the upper end 22. A friction fit may also be used.

Proximate the lower end 112 of the outer tube 42, a nut 118 is secured such as by welding to the sidewall 106. The nut 118 is here shown spaced away from the sidewall 106 to show the associated aperture 119 in the sidewall 106. A T-bolt 120 may be threadedly engaged with the nut 118 to extend through the corresponding aperture 119 in the sidewall 106 to extend inwardly for contact with the outer surface 82 of the sidewall 70 of the middle tube 40. As the T-bolt 120 is operated, it urges the middle tube 40 frictionally against the opposite interior surface 122 of the outer tube 42 while at the same time frictionally engaging the exterior surface 82 of middle tube 40 to inhibit relative movement between the outer tube 42 and the middle tube 40.

The T-bolt 120 and nut 118 together with the aperture 119 function as a locking means for locking the outer tube 42 or third telescoping member relative to the middle tube 40 or second telescoping member. It may be also noted that the recess 104 is spaced upwardly from the lower edge 124 a distance 126 selected to provide vertical stability between the middle tube 40 and the outer tube 42. In the preferred arrangement, the distance 126 may be about 3 inches when the outer tube has an outside width 125 of about 1.25 inches and has a 0.083 inch sidewall 106 thickness.

In reference to FIG. 2, it may be noted that the inner tube 38 is ¾ inch square tubing having a sidewall thickness of about 0.083 inches. The inner tube 38 is sized to be about 40 inches in length 50. The middle tube 40 is 1 inch square tubing with a wall thickness of about 0.083 inches. The middle tube 40 is sized to be about 40 inches in length 128. The outer tube 42 is 1¼ inch square tubing sized to be about 36 inches in length 130. Tubing of other dimensions may be used as desired to increase the strength of the upright structure for jacks to be used with vehicles or for objects of greater height or weight, or in circumstances where greater strength is required. However, for snowmobiles the dimensions have been found to be suitable. Further, round tubing or tubing in other cross-sectional shapes may be used as desired.

Figure 3:
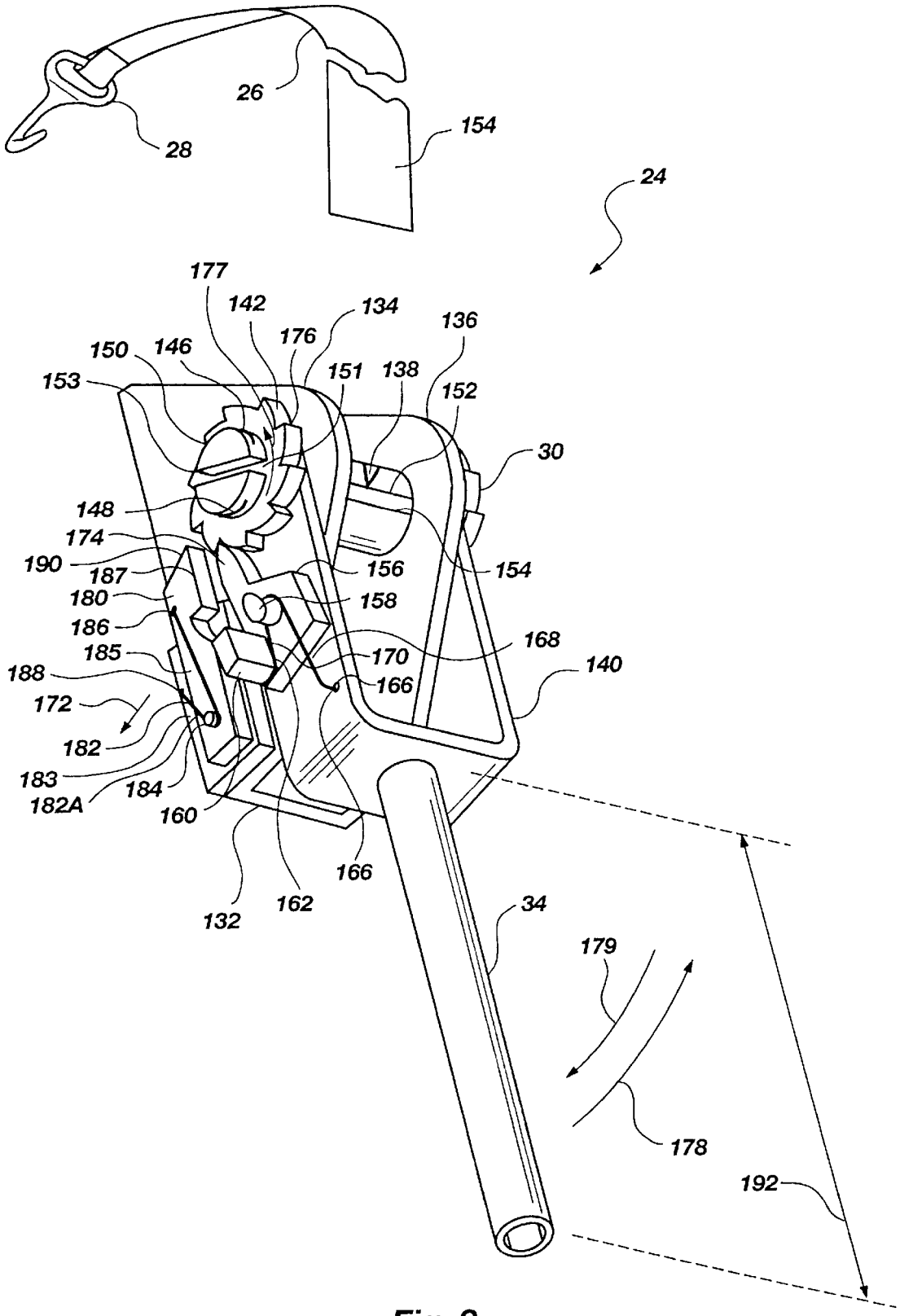
FIG. 3 is a perspective view of a lifting mechanism for use with the present invention.

Turning now to FIG. 3, a lift mechanism 24 is shown. It has a lift base 132 with a left upwardly extending side 134 and a right upwardly extending side 136. Apertures 137 and 139 are formed in the left side 134 and right side 136, respectively, to receive therethrough an axle 138. The axle preferably is formed of two half pins.

A yolk 140 is positioned to rotate about the axle 138. A left ratchet gear 142 and a right ratchet gear 30 are both positioned over the axle 138. The left ratchet gear 142 is held in place by a wire 146 that extends through an aperture 148 formed in the end 150 of the axle 138. A roll pin may be used in lieu of wire 146. A finger 151 of the ratchet gear 142 fits into the slot 153 so that the gear 142 and axle 138 rotate together.

Right ratchet gear 30 has a similar finger that co-acts with a slot in a similar fashion. A similar wire and aperture configuration is provided on the right side of the axle 138 but is not here shown. The ratchet gear 30 here holds the axle 138 in place. Other structures may be used in lieu of gear 30 to hold the axle 138 in the aperture 139 of the right side 136.

The axle 138 has a slot 152 with a tooth 154 positioned therein. The inner end 154 of the cloth strap 26 is insertable into the slot 152. In use, the strap is wound about the axle 138 in the space between the left side 134 and the right side 136 upon operation of the yoke 140 by manipulation of the handle 34 by a user.

The lifting mechanism 24 includes a left pawl 156 (FIG. 3) which is positioned to rotate about an axle 158. The pawl 156 has a tab 160 that extends outwardly from it about which a wire spring 162 is positioned. The wire spring 162 is further bent around the axle 158 and extends with a transverse portion 164 into an aperture 166. The spring 162 is formed so that the upper leg 168 and the lower leg 170 are being urged apart from each other. In turn, the force exerted on the tab 160 is downward 172 in FIG. 3. In turn, the tip 174 of the pawl 156 is continuously urged upward towards the separate cogs 176 of the left ratchet gear 142.

FIG. 1 shows a right pawl 32 positioned to contact gear 30. Although a left pawl 156 and gear 142 arrangement and a right pawl 32 and gear 30 arrangement may be used together, it is preferred that only one pawl be used such as the left pawl shown in FIG. 3.

With a downward force 27 (FIG. 1) being exerted on the strap 26, the left ratchet gear 142 will be urged in a counterclockwise direction 177. In turn, the individual cogs 176 of the left ratchet gear 142 will interact with the tip 174 of the pawl 156 to prevent movement.

It can also be seen that upon up 178 and down 170 rotation of the handle 34, the yoke 140 will move up and down in a similar manner to cause the tip 174 of the pawl 156 to rotate over individual cogs 176 of the left ratchet gear 142. Upon rotation of the handle 34 in an outward or upward direction 178, additional cogs 176 will be passed so that the user may stop and push in a downward direction 179, thereby urging the strap 26 in an upward direction, in turn causing a lifting force to be exerted on the hook 28. With the hook 28 properly in position, an object to be lifted can thereby be raised or moved. The right pawl 32 is similarly configured and assembled but is not here shown.

With the handle 34 and yoke 140 oriented as shown in FIG. 1, a lock 180 may be operated to engage the cogs 176 of the left ratchet gear 142 to in effect lock the ratchet gear 142 in a safe position and prevent downward movement of the strap 26.

Figure 4:
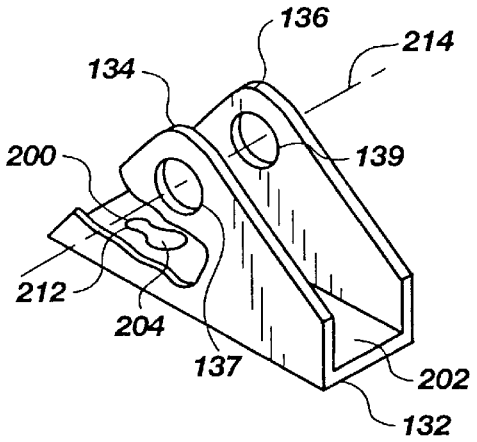
FIG. 4 is a perspective, partially cut-away view of a portion of the bracket of the lifting mechanism of FIG. 3.

A spring 182 may be provided which is wrapped around a rotational pin or axle 184 to extend between an aperture 186 in the lock 180 and an aperture 188 in the block spacer 183. The spring 182 has opposite legs 182A and 185 which are tensioned to urge themselves away from each other to in turn urge the tip 190 of the lock 180 toward the cogs 176 of the left ratchet gear 142. A similar lock is provided for the right ratchet gear 30. A similar pawl 32 may also be provided for the right ratchet gear 30 in order to provide for equal loading of the axle 138 and to preclude binding the axle 138 within the apertures 137 and 139 (FIG. 4).

The lock 180 also has a notch 187 formed in it. In use, the user may manually rotate the pawl 156 so that the tip 174 is aligned with and inserted into the notch 187. When so positioned, the lock 180 and the pawl 156 are both disassociated from the cogs 176 so the axle is free to rotate. In turn, the user may grasp the hook 28 and pull the strap 26 out from the lifting mechanism 24 for attachment to, for example, the snowmobile 12.

In use, the lock 180 is continuously urged toward engagement with the cogs 176. Thus, the axle 138 cannot rotate to unwind the strap 26 as the user lifts 178 the handle 34. That is, the lock 180 holds the axle 138 in place as the user repositions the handle 34. As the user rotates the handle 34 down 179 causing clockwise rotation of the ratchet gear 142, the lock 180 slides over adjoining cogs 176 to engage each passing cog 176 until the user stops rotation of the handle 34. At that time the lock 180 engages the last passing cog 176 to lock the axle 138 in place. The operation relative to the right ratchet gear 30 is the same.

It can also be seen in FIG. 3 that the handle 34 has a length 192 selected so the user may provide the leverage necessary for exerting an appropriate lifting force through the strap 26. A handle 34 may be sized anywhere from six inches to approximately one foot. Further, the handle 34 here shown is a circular metal bar over which additional structures may be placed or otherwise attached to provide additional leverage in given situations.

Referring specifically to FIG. 4, the lift base 132 is shown in cutaway with a keyhole 200 formed in the base portion 202. The keyhole 200 is sized with a larger portion 204 sized to receive a capped mounting stud or pin 206 best seen in FIG. 2. The top 208 of the pin fits through the larger portion 204 of the keyhole 200 with the base 210 of the pin sized to snugly but slidably move into the throat 212 of the keyhole 200. In turn, the lifting mechanism 24 is removably attachable to the upper end 22 of the upright structure 18. That is, the user may associate the lifting mechanism 24 with the upper end 22 by sliding the base 202 over the pin 206. With the axis 214 of the axle 138 spaced downwardly from the keyhole 200, the downward force exerted on the axle 138 when lifting rotates the base 202 towards the upright structure 18 to snugly hold it in place during operation. Although the base 132 is shown flat to fit against an outer surface of the outer tube 42, the base 132 can be shaped to mate with a shape of upright member 18. Also, the pin 206 is here shown mounted to sidewall 107 which is adjacent sidewall 106. In a more preferred arrangement, the pin 206 is mounted to sidewall 109 which is opposite sidewall 106. The pin 206 is here shown mounted to sidewall 107 to illustrate an alternate location and to facilitate clear illustration of pin 206.

The lifting mechanism 24 is sized so that it may be placed in a storage container 216 (FIG. 1) associated with the snowmobile 12. Thus, the user may remove the lifting mechanism and place it in a convenient out-of-the-way storage location during operation of the snowmobile 12.

Figure 5:
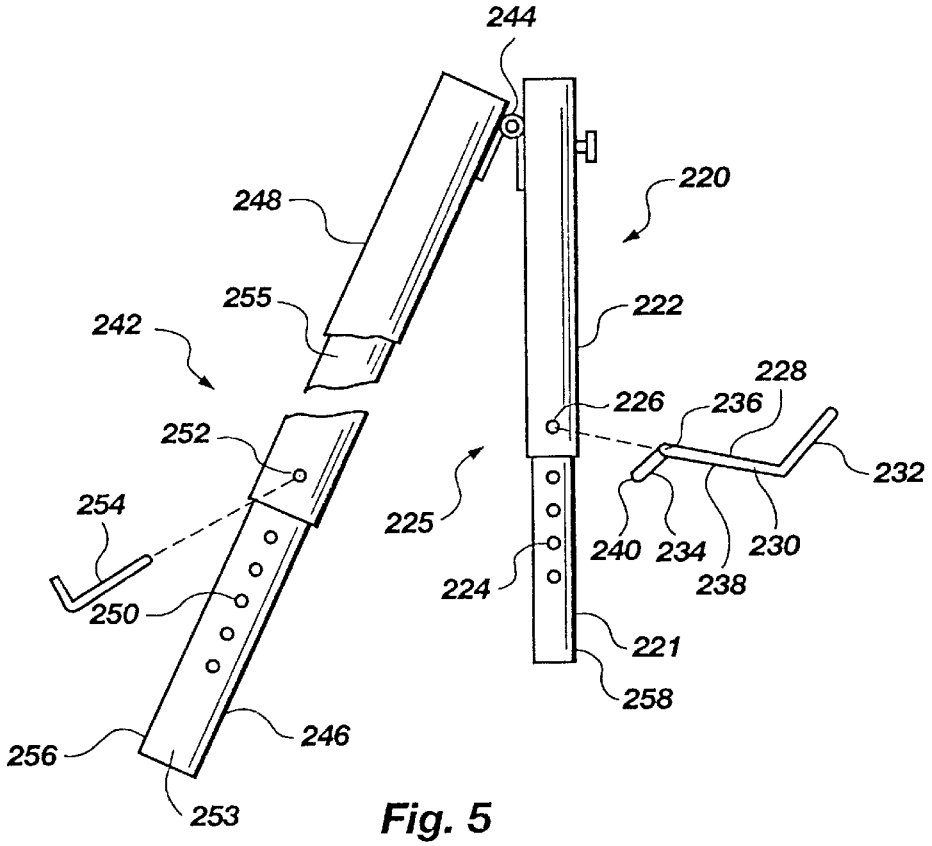
FIG. 5 shows an upright structure with a leg for use with the present invention.

Turning to FIG. 5, an alternative configuration is shown in which an upright structure 220 has at least two rectilinear in cross-section telescoping members comprised of a lower telescoping member 221 and an upper telescoping member 222. The lower telescoping member 221 has a plurality of apertures 224 formed along its length to register with a corresponding aperture arrangement 225 having the aperture 226 formed in one wall of the upper telescoping member 222 and another opposite aperture in the sidewall opposite that shown in a well known manner. A pin 228 may be inserted through the aperture arrangement 225 including aperture 226 to register with one of the plurality of apertures 224 and the aperture opposite aperture 226 in order to select the desired length or height of the upright structure 220.

Pin 228 as here shown has a solid or fixed base leg 230 with a handle portion 232 formed unitarily therewith to extend angularly away from the base leg 230. A foot 234 is rotatably connected to rotate about a pin 236 at the end 238 of the leg 230. Thus, the user may first insert end 240 of foot 234. Upon insertion of the pin 228 and more particularly the leg 230 through the aperture arrangement 225 including aperture 226 and a corresponding selected aperture of the plurality of apertures 224 as well as the aperture opposite aperture 226, the foot 234 may gravitationally rotate to be transverse to the leg 230. The force of gravity holding the foot 234 in the transverse position facilitates retention of the pin 228 in the aperture arrangement 225 and the related selected aperture of the plurality of apertures 224.

A separate leg 242 rectilinear in cross-section is connected to the upright structure 220 by a hinge 244. That is, the hinge 244 is attached to the upright structure 220 by welding, bolts or screws as desired. Similarly, it is held to the leg 242 by appropriate welding or bolts or screws as desired. The leg 242 may then be rotated toward or away from the upright structure 220. When spaced angularly away from the upright structure 220, the leg 242 provides a stabilizing element for further contact with the support surface 15B to in effect provide leverage to facilitate lifting.

The leg 242 may also be formed of a plurality of telescoping members such as, for example, a lower telescoping member 246 and an upper telescoping member 248. The lower telescoping member 246 has a plurality of apertures 250 formed along its length to selectively register with apertures 252 formed on one side 253 in the upper portion 248 of the leg 242 and in the side 255 opposite side 253. A pin 254 may be inserted through the aperture 252 to register with one of the plurality of apertures 250 and the aperture in the opposite side 255 of upper telescoping member 248 to secure the lower telescoping member 246 with the upper telescoping member 248 at a desired length. The lower end 256 of the leg 242 and the lower end 258 of the upright structure 220 may be formed in cross-section to readily slide or pass through snow 17 for positioning on the support surface 15B.

Figure 6:
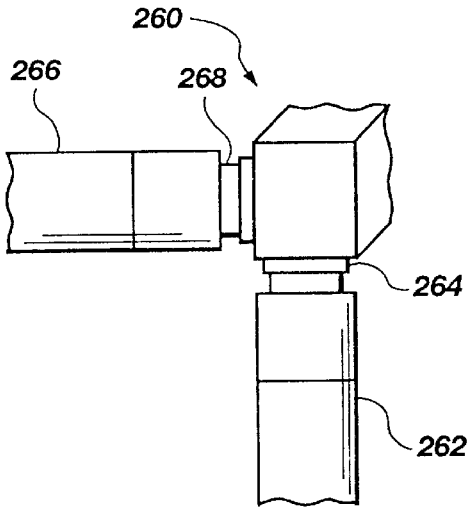
FIG. 6 shows an upright structure with a left leg and a right leg, all for use with the instant invention.

FIG. 6 is a top view of an upright structure 260 which may be similarly formed as the upright structure 18 or the upright structure 220. A first leg 262 may be secured to the upright structure 260 by hinge 264 secured in a manner similar to hinge 244. A second leg 266 may also be secured to the upright structure 260 by a hinge 268. In turn, the legs 262 and 266 may be rotated toward and away from the upright structure to create a variable footprint to provide stability for lifting. The footprint is defined by the distances between the legs 262 and 266 with upright structure 260. In lieu of hinges 264 and 268, various hooks, brackets or the like may be used to associate the legs 262 and 266 with the upright structure 260.

Viewed when collapsed, the upright structure 18 of FIGS. 1 and 2 will still have a length longer than 40 inches. In order to store the upright structure 18 on the vehicle and, more specifically, on a snowmobile 12, attaching means is provided to attach the upright structure 18 at a desired location. For snowmobile 12, it has been found desirable to attach the upright structure 18 to the running board 11 of the snowmobile 12 and, more specifically, to the outside edge of the running board 11. The attaching means here has a forward bracket and a rear bracket.

Figure 7:
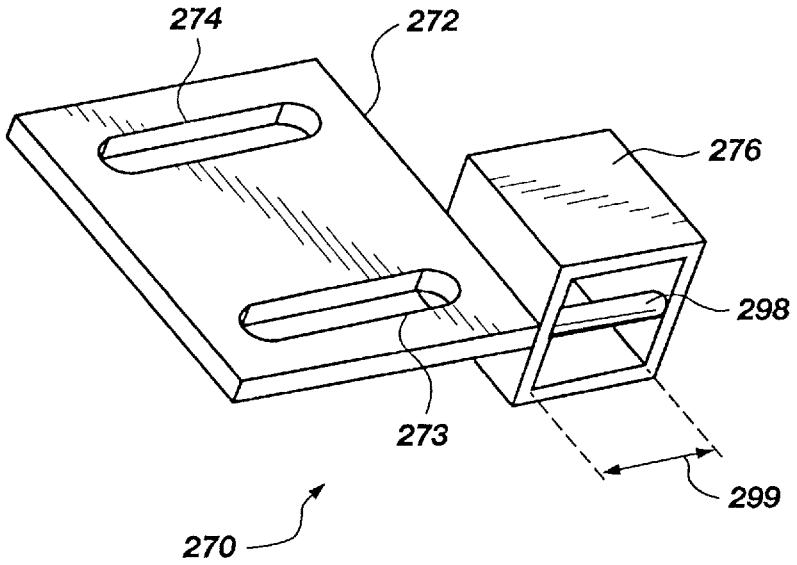
FIG. 7 is a perspective view of a forward bracket for mounting the upright structure of the off-road snow jack to a vehicle.

A forward bracket 270 is shown in FIG. 7. The forward bracket 270 has a securing plate 272 formed with two slotted apertures 274 and 273. The plate 272 is to be positioned on the underside of a running board 276 of a snowmobile (see FIGS. 9 and 10). Bracket 270 and, more particularly, the plate 272, is held against the underside 278 of the running board 276 by bolts 280 and 282 which extend through apertures formed in the running board to extend through the slots 274 and 273 for further connection to nuts 284 and 286. The nuts 284 and 286 threadedly engage the bolts 280 and 282. A flat spacer washer 288 and 290 as well as associated lock washers 292 and 294 are provided to facilitate the attachment of the nuts 284 and 286 with their respective bolts 280 and 282. Flat washers 277 and 279 may also be used to retain the bolt heads 281 and 283 from contact with the running board 276.

The bracket 270 also has housing 296 which is sized to receive the lower end 20 of the upright structure 18. The lower end 20 abuts a stop pin 298 which extends across the width 299 of the housing 296. The housing 296 is secured to the plate 272 by welding or by any other convenient means as desired.

Figure 8:
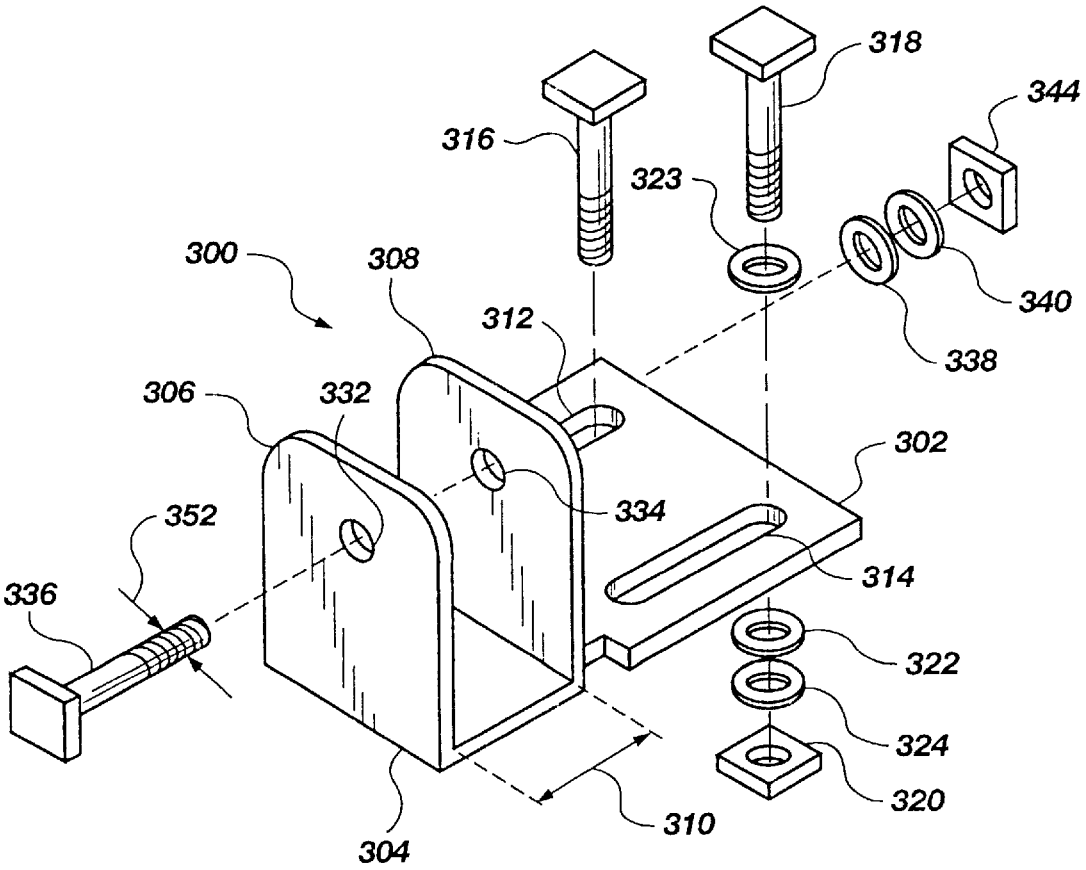
FIG. 8 is a perspective view of a rear bracket for attaching the upright structure of a snow jack of the present invention to a vehicle.

A rear bracket 300 is shown in FIG. 8. It includes a base plate 302 secured to a U-shaped receiver 304. That is, the U-shaped receiver 304 has a left side 306 and a right side 308 which are spaced apart a distance 310 which is the distance so the outer tube 42 of the upright structure 18 may snugly and slidably fit therebetween. The base plate 302 has slots 312 and 314 formed therein through which bolts 316 and 318 pass for interconnection to respective nuts. For example, bolt 318 extends through the slot 314 for threaded connection with nut 320. Appropriate flat washers 322 and 323 and lock washer 324 may also be provided to facilitate the attachment.

The bolt 318 passes through an aperture that is formed in the running board 276 of the snowmobile for interconnection with the washers 322, 323 and 324 and the nut 320. Bolt 316 connects with the nut 326 and washers 328, 329 and 330, as better seen in FIG. 10.

The U-shaped bracket 304 has an aperture 332 formed in the left side 306 and an aperture 334 formed in the right side 308 to receive a bolt 336 therethrough for further connection with a flat washer 338, a lock washer 340 and a nut 344. The bolt 336 and nut 344 when threadedly engaged may be operated to move the left side 306 and the right side 308 toward each other to effect a clamping force about the outer tube 42 when it is positioned thereinbetween. Further, the outer tube 42 may have a pair of spaced apart tips 346 and 348 (FIG. 2) attached on sidewall 107. However, preferably the tips 346 and 348 are attached to sidewall 109 which is opposite sidewall 106. The tips 346 and 348 are shown attached on sidewall 107 to illustrate an alternative and to facilitate illustration.

Figure 9:
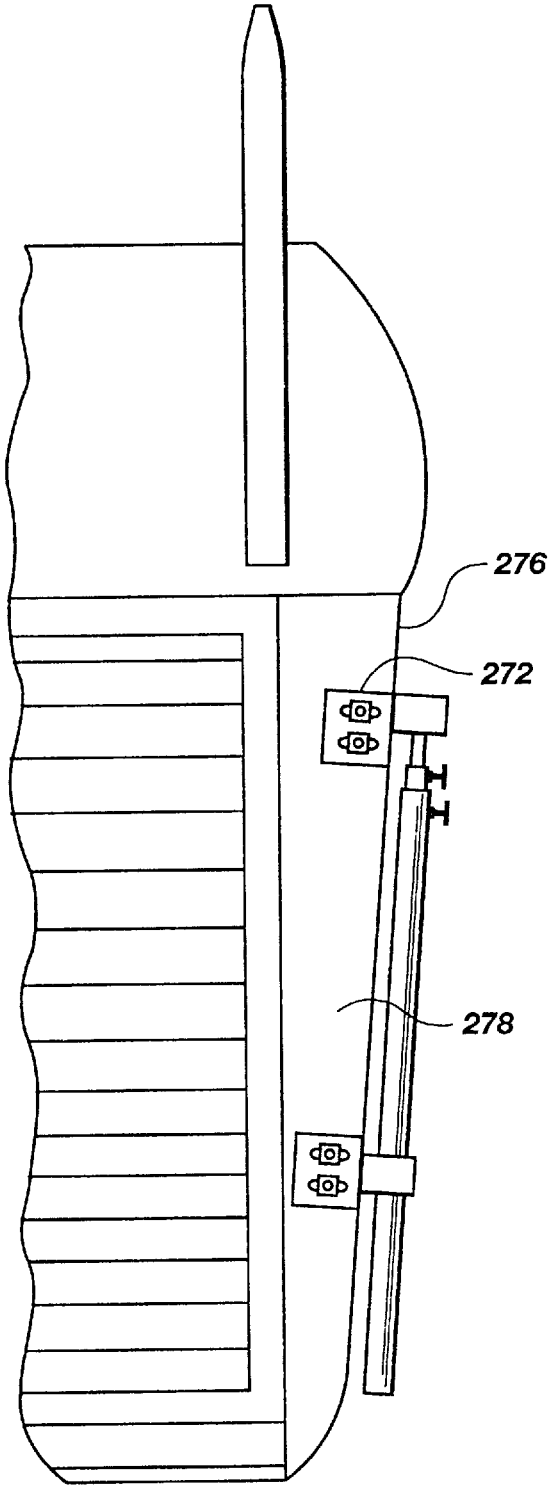
FIG. 9 shows a partial bottom view of a snowmobile with the brackets of FIGS. 7 and 8 attached thereto and with an upright structure associated therewith.
Figure 10:
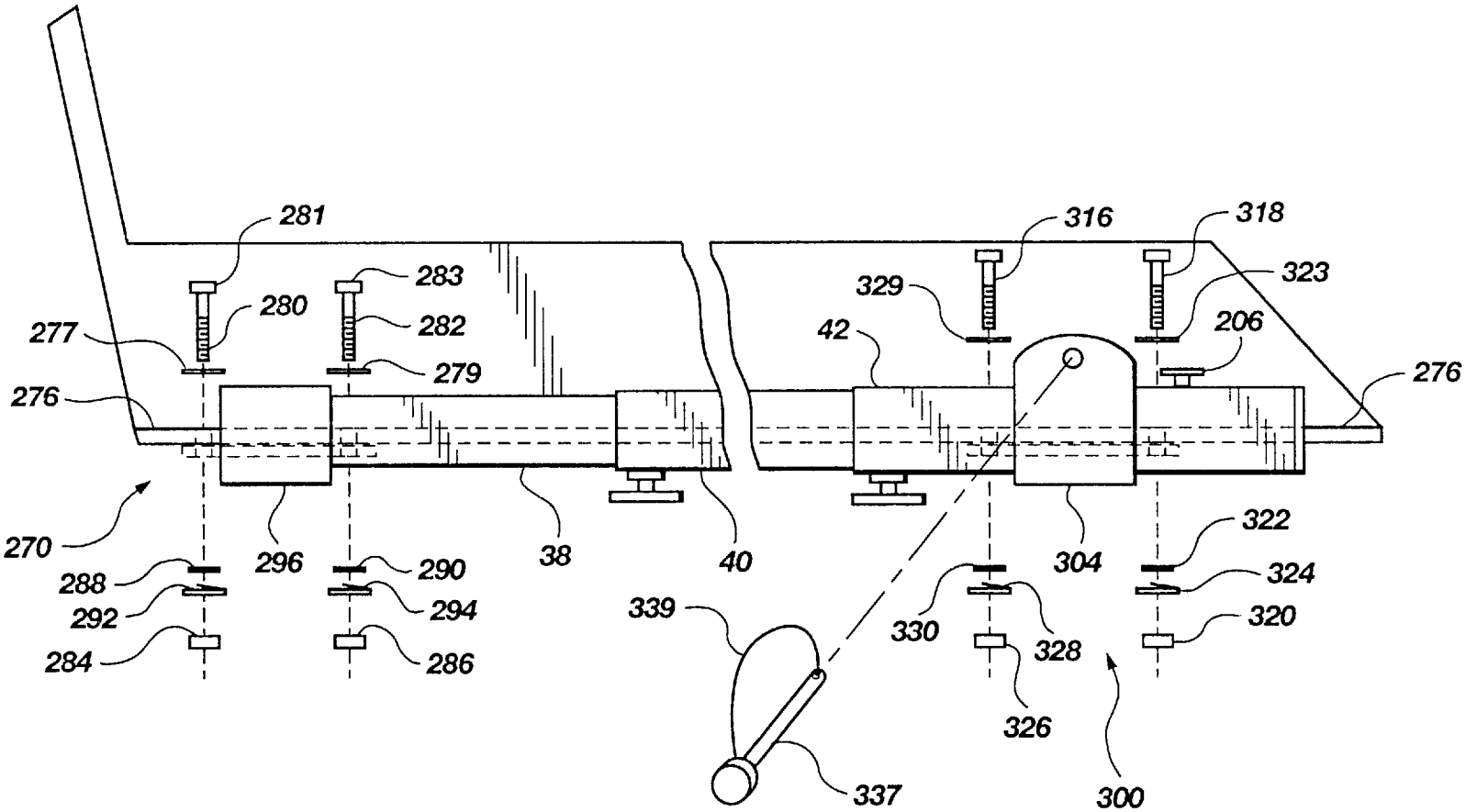
FIG. 10 shows portions of a snowmobile with the forward bracket and the rear bracket connected thereto and with the upright structure of the off-road snow jack of the present invention associated therewith.

The tips 346 and 348 are spaced apart a distance 350 which is approximately the diameter 352 of the bolt 336. The tips 346 and 348 are positioned along the length 130 of the outer tube 42 to register with bolt 336 when the upright structure 18 is positioned alongside the running board 276 as shown in FIGS. 9 and 10. In turn, movement of the outer tube 42 relative to the bracket 300 is inhibited. Alternative arrangements for securing the upright structure and, more particularly, the outer tube 42 to the bracket 300 may be provided, including the use of threaded apertures in the sidewall 107 of the outer tube 42 to receive a locking bolt. A variety of other arrangements may also be used as desired.

For example, a pin 337 is preferably used in lieu of bolt 336 to secure the upright structure 18 in the bracket 300. The pin 337 is sized to sideably fit through apertures 332 and 334 (FIG. 8) and is held in place by a locking wire 339. Of course, the brackets 270 and 300 may be secured to the left running board 276 or the right running board (not shown) of the machine.

Figure 11:
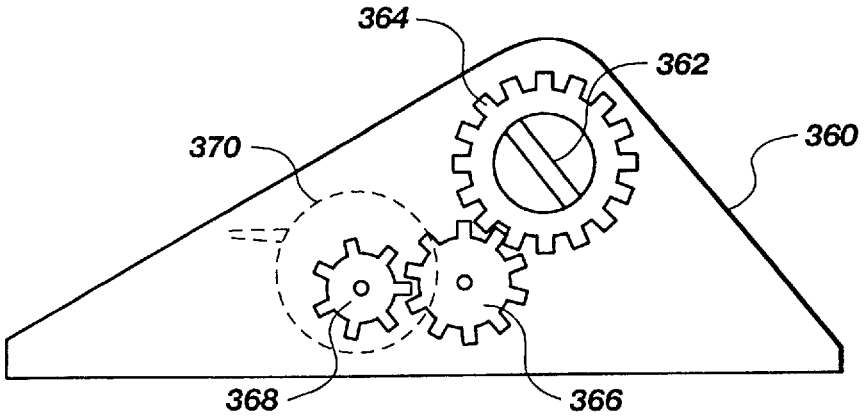
FIG. 11 shows an alternative lifting mechanism for use with the present invention.

Referring for a moment to FIG. 11, and alternative lifting mechanism is shown having a base 360 formed with a axle 362 comparable to axle 138 (FIG. 3). In lieu of the ratchet gear 142, a single-toothed gear 364 is fixedly secured to the axle 362 in a fashion similar to the ratchet gear 142 or by other appropriate locking pins, clevis pins or the like. Additional gearing 366 and 368 for further rotation by a motor 370 is also provided. The motor 370 provides rotational torque through the gears 368 and 366 to drive the gear 364 to in turn drive the axle 362 to rotate the strap such as strap 26. The motor 370 may be reversible so the user may operate the axle 362 in both a clockwise and counterclockwise direction to effect raising and lowering of the connection structure such as the strap 26. For certain vehicles, battery power may be available to operate the motor 370. A lock comparable to lock 180 may be used on the side opposite that shown as a safety to restrain the axle 362 from rotation under load.

In operation, the user will necessarily remove the upright structure 18 from a storage location and cause telescoping members 38, 40 and 42 to be operated and locked relative to each other by operation of the bolts 84 and 120 to position the lifting mechanism 24 at a desired height 36 above the surface 15. The lower end of the upright structure 18 is positioned through the snow 17 to contact the support surface 15. The lifting mechanism 24 is positioned at the upper end 22 of the upright structure 18 by interconnecting the keyhole 200 with the associated pin 206 on the outer tube 42. The user may then operate the lifting mechanism 24 by causing the pawl 156 and the lock 180 to be removed from the cogs 176 to in turn allow the user to pull the strap 26 downwardly towards the object to be lifted, such as snowmobile 12.

The associated hook 28 is then positioned as shown in FIG. 1 on the machine near a trailer hitch 372 or at any other convenient ledge anywhere around the perimeter of the snowmobile 12. The user may then cause the lock 180 to be operated so the lock 180 and pawl 156 engage the separate cogs 176 of the ratchet gear 142. Similar structure is operated to engage gear 144. Upon operation of the handle 34 in an up 178 and down 179 direction, the strap 26 will be urged upwardly toward the axle 138 to in turn cause a lifting force to be exerted with respect to the snowmobile shown in FIG. 1 or on any other object to be lifted or moved.

As stated, some amount of rotational torque may be exerted at the upper end 22 of the upright structure 18 when lifting to cause the upright structure 18 to move toward or away 374 from the object to be lifted. The user may thereby need to hold onto the upper end 22 and urge the upper end 22 in a direction opposite to the force being exerted when the lifting mechanism 24 is being operated in order to maintain stability of the upright structure 18 in use. Of course, in operating the handle 34, the user is preferably positioned proximate the upright structure 18 in a position to place one hand on the handle 34 and the other hand proximate the upper end 22. Typically, the user would exert a force outwardly 376 while causing an up-and-down force to be exerted on the handle 34.

In use, the snow jack of FIG. 1 may be positioned proximate other objects to be lifted such as a tree limb or other interfering structures. That is, an off-road vehicle user may confront a downed tree which interferes with progress. The snow jack may be positioned proximate such an object with the strap 26 wrapped about the trunk or arm of a limb of a tree downed and in front of the user and operated in a manner similar to that herein described.

When the object to be lifted has been satisfactorily moved, then the user may return the snow jack 10 to its storage position. For the snowmobile 12 of FIG. 1, the lifting mechanism 24 can be removed and placed in the storage compartment 216. The telescoping members 38, 40 and 42 can be all moved relative to each other upon loosening of the bolts 84 and 120. The lower end 20 of the upright structure 18 may then be placed in the housing 296 to extend rearward with the tips 346 and 348 extending upwardly on either side of the apertures 332 and 334 so that the bolt 336 may pass thereinbetween in order to secure the outer tube 42 and the upright structure 18 therein. Appropriate operation of the bolt 336 with the nut 344 will facilitate the attachment and allow the user to operate the snowmobile 12 with the upright structure out of the way under or adjacent the running board but yet readily available when needed.

It should be understood that the illustrated embodiments are not intended to limit the scope of the claims which themselves recite those features which are regarded as essential to the invention.

What is claimed is:

1. An off-road snow jack system comprising:

an upright structure for positioning proximate an object to be jacked, said upright structure having a lower end sized in cross section to pass through snow to contact a support surface thereunder, said upright structure having an upper end, and said upright structure being sized in height to extend above the object to be jacked;

a lifting mechanism removably positionable proximate said upper end, said lifting mechanism including:

connection structure for removable connection to said object to be jacked, and operation means to which said connection structure is attached, said operation means being operable to tension said connection structure to urge said object to be jacked to move; and attaching means attachable to the object to be jacked for removably attaching said upright structure thereto.

2. A snow jack system for use with a snowmobile having a running board, said snow jack system comprising:

an upright structure for positioning proximate a snowmobile, said upright structure having a lower end sized in cross section to pass through snow to contact a support surface thereunder, said upright structure having an upper end and being sized in height to extend above said snowmobile;

a lifting mechanism removably positionable proximate said upper end, said lifting mechanism including:

connection structure for removable connection to said snowmobile, and operation means to which said connection structure is attached, said operation means being operable to tension said connection structure to urge said snowmobile to move; and attaching means attachable to the running board of the snowmobile for removably attaching said upright structure thereto.

3. The snow jack system of claim 2, wherein said attaching means includes a forward bracket for removably receiving one end of said upright structure and a rear bracket spaced from said forward bracket for removably receiving said upright structure therein.

4. The snow jack system of claim 3, wherein said rear bracket includes a pair of spaced apart members to receive said upright structure thereinbetween and wherein said rear bracket includes securing means for securing said upright structure thereto.

5. The snow jack system of claim 4, wherein said securing means includes apertures formed in said pair of spaced apart members, a bolt sized to extend therethrough, and an extension attached to said upright structure positioned to contact said bolt when said bolt is positioned in said apertures in said pair of spaced apart members to inhibit movement of said upright structure relative to said rear bracket.

6. The snow jack system of claim 5, wherein said upright structure includes a first telescoping member which telescopes relative to a second telescoping member, and wherein said upright structure includes first locking means for inhibiting relative movement between said first telescoping member and said second telescoping member.

7. The snow jack system of claim 6, wherein said upright structure includes a third telescoping member which telescopes relative to said second telescoping member and wherein said upright structure includes second locking means for inhibiting relative movement between said second telescoping member and said third telescoping member.

8. A snow jack system for use with a snowmobile, said snow jack system comprising:

an upright structure for positioning proximate a snowmobile, said upright structure having a lower end sized in cross section to pass through snow to contact an underlying support surface, said upright structure having an upper end and being sized in height to extend above said snowmobile, said upright structure including:

a first telescoping member which telescopes relative to a second telescoping member, first locking means for inhibiting relative movement between said first telescoping member and said second telescoping member, a third telescoping member which telescopes relative to said second telescoping member, and second locking means for inhibiting relative movement between said second telescoping member and said third telescoping member;

a lifting mechanism removably positionable proximate said upper end, said lifting mechanism including:

connection structure for removable connection to said snowmobile, and operation means to which said connection structure is attached, said operation means being operable to tension said connection structure to urge said snowmobile to move;

a forward bracket for removably receiving one end of said upright structure; and a rear bracket for removably receiving said upright structure therein.

9. The snow jack system of claim 8, wherein said operation means is a manual ratchet and pawl assembly.

10. The snow jack system of claim 9, wherein said rear bracket includes a pair of spaced apart members to receive said upright structure thereinbetween and wherein said rear bracket includes securing means for securing said upright structure thereto.

11. The snow jack system of claim 10, wherein said securing means includes apertures formed in said pair of spaced apart members, a bolt sized to extend therethrough, and an extension attached to said upright structure positioned to contact said bolt when said bolt is positioned in said apertures of said pair of spaced apart members to inhibit movement of said upright structure relative to said securing means.

12. The snow jack system of claim 11, wherein said first telescoping member has a fiberglass core.

13. The snow jack system of claim 12, wherein said first telescoping member is about one inch square.

* * * * *